US005144545A

United States Patent [19]

Klitzing

[11] Patent Number: 5,144,545

[45] Date of Patent: Sep. 1, 1992

[54] SAFETY LIGHT FOR SWIMMING POOL

[76] Inventor: David W. Klitzing, Rte. 2, Box 143, Altamont, Ill. 62411

[21] Appl. No.: 747,937

[22] Filed: Aug. 21, 1991

[51] Int. Cl.[5] ..... F21V 33/00

[52] U.S. Cl. ..... 362/101; 362/223; 362/293; 362/318; 362/363; 362/370

[58] Field of Search ..... 362/101, 154, 223, 226, 362/253, 267, 363, 370, 378, 432, 293, 318

[56] References Cited

U.S. PATENT DOCUMENTS

| | | | |
|---|---|---|---|
| 1,185,904 | 6/1916 | Hendricks | 362/267 |
| 1,909,404 | 5/1933 | Horn | 362/267 |
| 1,955,361 | 4/1934 | Flashman | 240/4 |
| 2,443,829 | 6/1948 | Lancry et al. | 240/4 |
| 3,008,679 | 11/1961 | Powell | 248/226 |
| 3,116,884 | 1/1964 | Lowther | 240/26 |
| 3,502,861 | 3/1970 | Evans | 240/26 |
| 3,617,733 | 11/1971 | Adams | 240/26 |
| 3,864,562 | 2/1975 | Hawkins | 240/26 |
| 4,100,593 | 7/1978 | Bond | 362/267 |
| 4,503,489 | 3/1985 | Duerr et al. | 362/101 |
| 4,785,386 | 11/1988 | Denis et al. | 362/428 |
| 4,947,304 | 8/1990 | Payne et al. | 362/267 |

*Primary Examiner*—Stephen F. Husar
*Attorney, Agent, or Firm*—Grace J. Fishel

[57] ABSTRACT

A safety light for a swimming pool that can be installed without draining the pool. The safety light has a lamp and casing assembly supported by an elongated bracket. The bracket is attached proximate its upper end to a sidewall of the swimming pool above the water line and the lamp and casing assembly is supported by the elongated bracket proximate its lower end. The bracket can be a tube which is capped at its lower end, filled with water and colored with a dye for the purpose of filtering the light to minimize the safety light's attraction for bugs.

8 Claims, 2 Drawing Sheets

SAFETY LIGHT FOR SWIMMING POOLThe present invention relates to a safety light for a swimming pool that can be installed without draining the pool.

BACKGROUND OF THE INVENTION

Many families (particularly owners of above-the-ground pools) are not home during the day and need to swim at night or, even if they are at home, find it too hot to swim during the day. It is dangerous, however, to swim at night in a swimming pool without underwater lights. Lights from above are effective at illuminating the pool side but make the water look black. If a swimmer gets into trouble, it may be difficult to find him in the dark, particularly at the deep end of the pool.

Accidents and panic situations may arise in a variety of ways. For example, children who cannot swim like to jump into the deep end of a pool wearing a "floatie". If the floatie breaks or if the child falls off or is pushed off, it may be necessary to rescue him. There are many other ways for a mishap to occur. For example, a person may dive into the water and hit the bottom in the dark or miss the deep water drop off and suddenly find himself in over his head and so forth.

Underwater lights are sold for in-the-ground pools and above-the-ground pools but are more common in the case of in-the-ground pools. For both types, however, commercially available underwater lights are relatively expensive and are designed to be installed through the sidewall of the pool. Unless they are installed when the pool is built, the installation requires that the pool be drained. In addition, particularly with above-the-ground pools, there is a substantial chance that water will leak through the sidewall around the light.

Because of the expense, many pools (in-the-ground and above-the-ground) do not have underwater lights, notwithstanding the need for them.

A solution to the above-mentioned problem came about by accident, quite literally, when the applicant broke the glass envelope (which is very fragile) of an underwater halogen fishing light sold by the Brinkmann Corporation under U.S. Pat. No. 4,947,304. The applicant replaced the envelope with a tube from a rain gauge and installed a plexiglass tube around it to prevent breakage. In testing the device for water tightness, discovered that the light illuminated his swimming pool. The cord for the light, however, was a safety hazard to swimmers and the light drew copious numbers of bugs (the purpose for which it designed as a fishing light).

OBJECTS AND SUMMARY OF THE INVENTION

It is an object of the present invention to provide a safety light for a swimming pool that can be readily installed without draining the pool. Another important object is to minimize the light's attraction for bugs. Other objects and features of the invention will be in part apparent and in part pointed out hereinafter.

In accordance with the invention, a safety light is formed in major part from a lamp and casing assembly supported by an elongated bracket. More particularly, the lamp and casing assembly includes a high output lamp sealed in a transparent casing with a watertight closure member. The lamp is connected to current carrying lines passing though the watertight closure member. The elongated bracket has first (upper) and second (lower) ends with means for supporting the lamp and casing assembly proximate the lower end of the elongated bracket. The elongated bracket has means for detachably attaching the bracket vertically to a sidewall of a swimming pool above the water line proximate the upper end of the bracket.

In an illustrative embodiment, the elongated bracket is a tube fitted loosely over the lamp and casing assembly. The tube is capped at its lower end and filled with water. The water is colored with a dye for the propose of reducing the safety light's attraction for bugs.

The invention as summarized above comprises the constructions hereinafter described, the scope of the invention being indicated by the subjoined claims.

BRIEF DESCRIPTION OF THE DRAWINGS

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
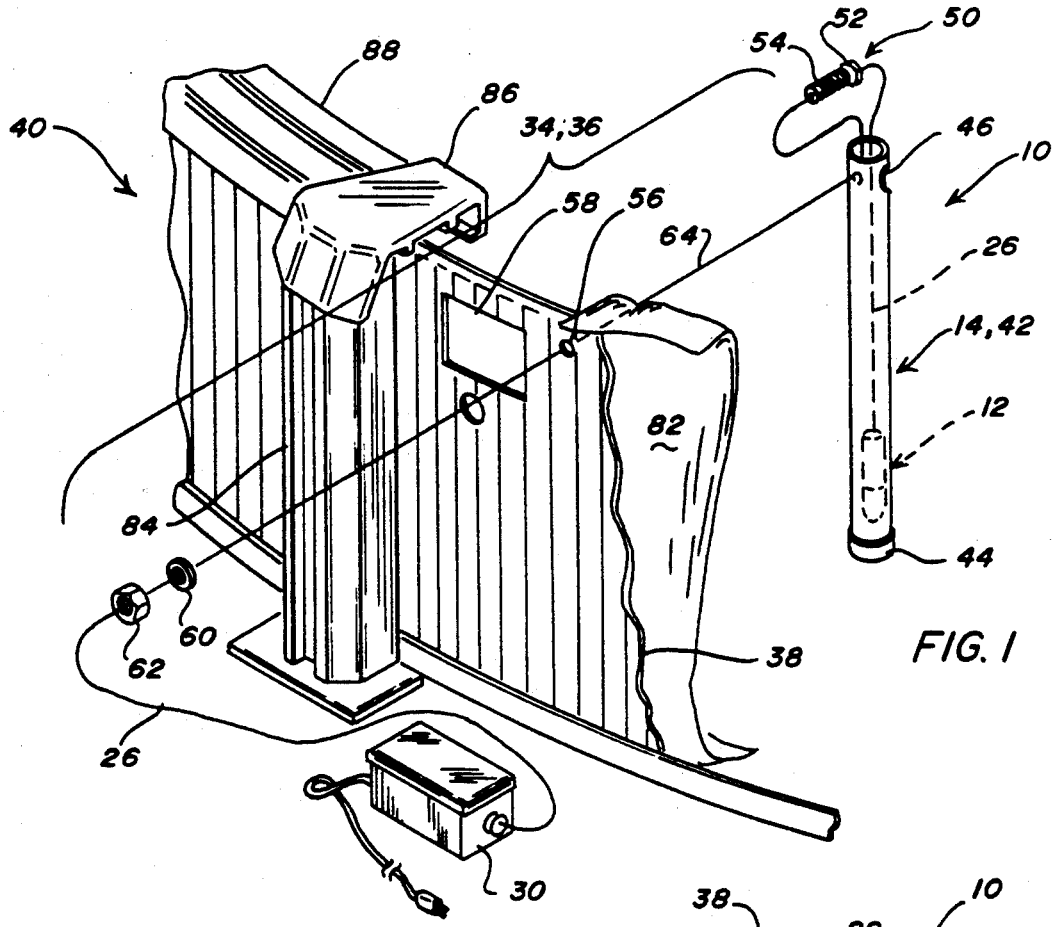
FIG. 1 is an exploded perspective view of a safety light in accordance with the present invention attached to a sidewall of an above-the-ground pool.

Referring to the drawings more particularly by reference character, reference numeral 10 refers to a safety light in accordance with the present invention. Safety light 10 in major part includes a high output lamp and casing assembly 12 and an elongated bracket 14 having first and second ends 16, 18 for suspending the lamp and casing assembly as more particularly described below.

Lamp and casing assembly 12 includes a high output lamp 20 sealed in a transparent casing 22 with a watertight closure member 24. Lamp 20 is connected to current carrying lines 26 passing through the watertight closure member. Lamp 20 is preferably a halogen lamp having an output of anywhere from about 20 watts to over 100 watts and transparent casing 22 is preferably formed of hardened glass, quartz or other suitable heat resistant material. Watertight closure member 24 preferably takes the form of a rubber stopper having a tapered outer surface and a central longitudinal hole through which current carrying lines 26 pass. Watertight closure member 24 and current carrying lines 26 are preferably made of or covered with clear plastic material to minimize their visibility in the water. A pair of O-rings 28 serve as bumpers and are slipped over transparent casing 22 to protect the casing from breakage.

For safety, lamp 20 is designed to operate at a low voltage and current carrying lines 26 are attached to a 12 volt transformer 30 (preferably in circuit with a ground fault inhibitor). Alternatively, current carrying lines 26 can be attached to a 12 volt battery.

In some instances, lamp and casing assembly 12 is weighted such that it sinks in the water. To this end, lamp 20 plugs into a hollow socket assembly 32 filled with ballast such as lead pellets or the like. Weighting is required for the two embodiments of safety light 10 shown in FIGS. 1-4 but, as will be understood from the description which follows, is not required for the embodiment shown in FIGS. 5-6.

Figure 3:
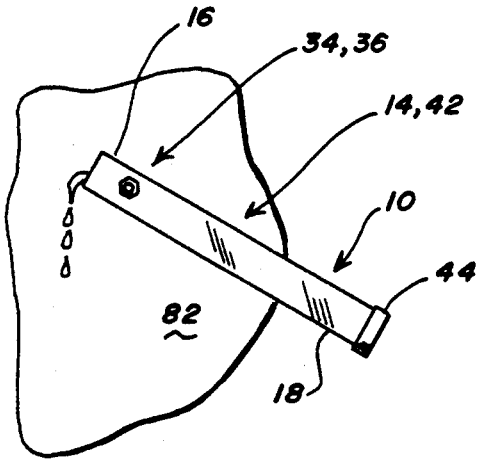
FIG. 3 is a front view of the safety light shown in FIG. 1 in process of being drained.
Figure 2:
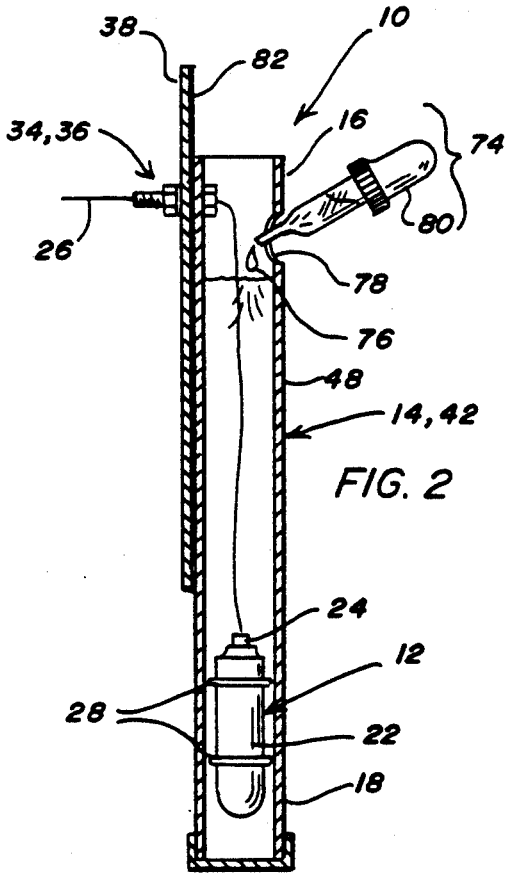
FIG. 2 is a side view in cross section of the safety light shown in FIG. 1 on an enlarged scale.

Elongated bracket 14 is outfitted with means 34 for suspending lamp and casing assembly 12 proximate second end 18 of the bracket and with means 36 for detachably attaching the bracket vertically to a sidewall 38 of a swimming pool 40 above the water line proximate first end 16 of the bracket. As shown in FIGS. 1-3, bracket 14 is a transparent plastic tube 42 fitted loosely over lamp and casing assembly 12. Tube 42 is closed at its second end 18, for example, with cap 44 and filled with water. A hole 46 is provided through a sidewall 48 of tube 42 proximate the first end. A bolt 50 with a head 52 connected to a threaded shank 54 is received in tube 42 with the shank sticking out hole 46. The shank of bolt 50 passes through a hole 56 provided in sidewall 38 of swimming pool 40 above the water line and preferably in the vicinity of a skimmer 58. On the exterior of sidewall 38, a slip nut 60 is threaded over shank 54 and secured with nut 62.

A passageway 64 is provided through head 52, shank 54 and nut 62 for current carrying lines. Passageway 64 is sized to grip the current carrying lines such that the weight of lamp and casing assembly 12 does not cause the current carrying lines to slip in the passageway after they have been adjusted to a selected length. As shown in FIGS. 1-3, bolt 50 serves as means 34 for suspending lamp and casing assembly 12 and as means 36 for detachably attaching the bracket vertically to sidewall. In the drawings, passageway 64 protects current carrying lines 26 from abrasion against the edges of holes 46, 56 through sidewalls 48, 38, respectively.

Figure 4:
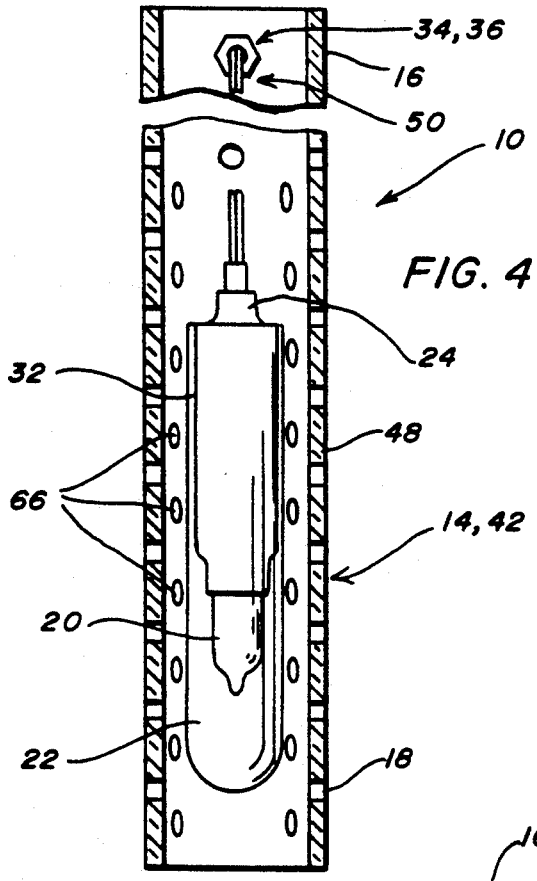
FIG. 4 is a front view in cross section of a second safety light in accordance with the present invention.
Figure 5:
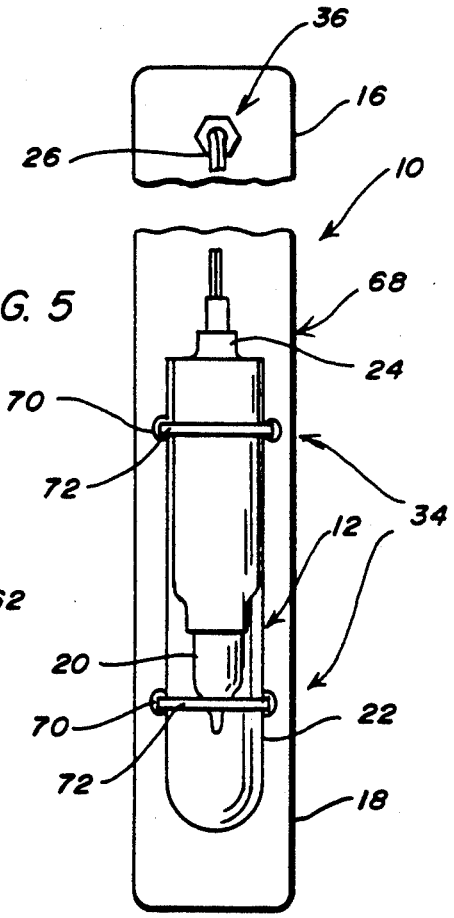
FIG. 5 is a front view of a third safety light in accordance with the present invention; and, FIG. 6 is a side view of the third safety light shown in FIG. 5.
Figure 6:
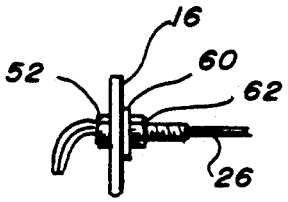
Figure 6:
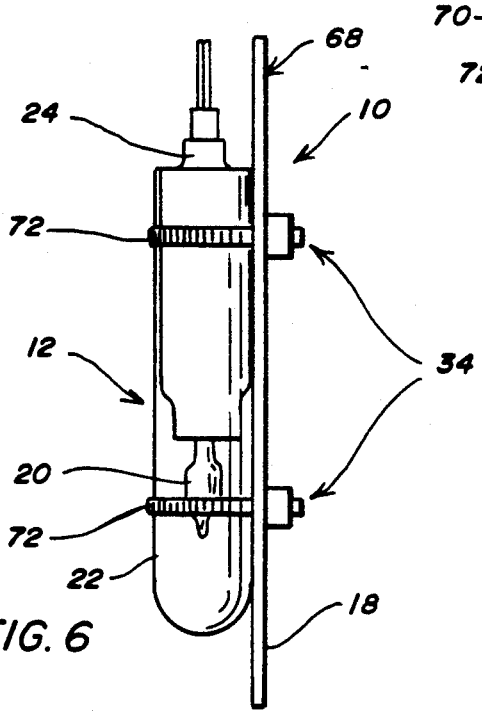

A second embodiment of safety light 10 is shown in FIG. 4 wherein bracket 14 is like the bracket shown in FIGS. 1-3 except that tube 42 is open at its second end 18 and sidewall 48 has a plurality of holes 66. A third embodiment of safety light 10 is shown in FIGS. 5-6. In this embodiment, bracket 14 is a transparent slat 68. Hole 46 is provided in slat 68 proximate the first end comparable to hole 46 provided in tube 42 for detachable attachment of safety light 10 to sidewall 38 of swimming pool 40. Two pair of holes 70 are provided proximate the second end of slat 68 for attachment of lamp and casing assembly 12 with bands 72 and O-rings 28 are omitted. Since lamp and casing assembly 12 is attached to slat 68, it is not necessary for lamp and casing assembly 12 to be weighted.

Because lamp 20 is very bright, safety light 10 tends to draw bugs. It is therefore advantageous to position safety light 10 near skimmer 58 such that any bugs falling into the water are immediately removed. It is also preferable that a means 74 for applying a colored filter to lamp 20 be provided. One possible filter means 74 is shown in FIGS. 1-3, wherein a dye 76 is applied to the water inside of tube 42 through an aperture 78 provided in sidewall 48 at first end 16 above the water line. As shown in FIG. 2, dye 76 may be added through aperture 78 with an eye dropper 80 or the like. If the user wants to change the color of filter means 74, this is accomplished as shown in FIG. 3 by pivoting tube 42 about means 34, 36 to drain the water, refilling the tube with water and adding a different dye. Other possible filter means 74 are provided by coloring the sidewalls 48 of tube 42 or of casing 22, by applying a colored sleeve thereover and so forth.

In use as shown in FIGS. 1-3, swimming pool 40 is an above-the-ground pool. A liner 82 is secured to the top edge of metal sidewall 38 supported by a plurality of vertical legs 84 spaced about the periphery of the pool. The top edge is finished with a connector 86 which joins adjacent sections of top rails 88. Safety light 10 is easily installed by cutting hole 56 through liner 82 and sidewall 38 above the water line near skimmer 58. Bracket 14 carrying lamp and casing assembly 12 is detachably attached vertically to sidewall 38 with means 36 and current carrying lines 26 attached to a power source. If swimming pool 40 is an in-the-ground pool, current carrying lines 26 can be brought over the lip of the pool and bracket 14 formed with a hook or the like on its first end for gripping the lip of the pool.

One safety light 10 has been found completely sufficient for small pools but for bigger pools, they are employed in whatever numbers are needed for illumination. As compared with commercially available underwater pool lights, safety light 10 is cheaper to make and easier to install since it does not require draining the pool. Safety light 10 also enhances the beauty of the pool in addition to making it safer for night swimming.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A safety light comprising a high output lamp sealed in a transparent casing with a watertight closure member, said lamp connected to current carrying lines passing through the watertight closure member; and, an elongated bracket having first and second ends with means proximate the first end for detachably attaching the bracket vertically to a sidewall of a swimming pool above the water line and with means for suspending the lamp and casing assembly proximate the second end of the elongated bracket whereby the safety light can be installed in the swimming pool without draining the pool.

2. The safety light of claim 1 wherein the elongated bracket is a transparent plastic tube fitted loosely over the lamp and casing assembly, said tube closed at the second end and having an aperture at the first end through which a dye can be added.

3. The safety light of claim 2 wherein the means for detachably attaching the bracket comprises a bolt with a head and a threaded shank, said bolt received in the tube with the shank sticking out of a hole in the tube proximate the first end, said threaded shank passing though a hole in the sidewall of the swimming pool and secured with a nut; and, wherein the means for suspending the lamp and casing assembly comprises a passageway through the head and shank of the bolt and through the nut, said passageway sized to grip the current carrying lines such that the weight of the lamp and casing assembly does not cause the current carrying lines to slip in the passageway after they have been adjusted to a selected length for suspending the lamp and casing assembly proximate the second end of the tube.

4. The safety light of claim 3 wherein the high output lamp is weighted.

5. A safety light comprising a halogen lamp sealed in a transparent glass casing with a watertight closure member, said lamp connected to current carrying lines passing through the watertight closure member;

a transparent plastic tube fitted loosely over the halogen lamp and casing assembly having first and second ends, said tube having means proximate the first end of the tube for detachably and pivotally attaching the tube to a sidewall of a swimming pool above the water line such that the tube hangs generally vertically, said tube closed at the second end such that the tube can be filled with water and further having means for suspending the lamp and casing assembly proximate the second end of the tube; and, means for applying a colored filter to the light from the halogen lamp emitted through the transparent plastic tube whereby the safety light can be installed without draining the pool and its attractiveness to bugs is minimized.

6. The safety light of claim 5 wherein the tube has an aperture in the first end above the water line and wherein the means for applying a colored filter comprises a dye which is added through the aperture to the water in the tube.

7. The safety light of claim 6 wherein the means for detachably attaching the bracket comprises a bolt with a head and a threaded shank, said bolt received in the tube with the shank sticking out of a hole in the tube proximate the first end, said threaded shank passing though a hole in the sidewall of the swimming pool and secured with a nut; and, wherein the means for suspending the lamp and casing assembly comprises a passageway through the head and shank of the bolt and through the nut, said passageway sized to grip the current carrying lines such that the weight of the lamp and casing assembly does not cause the current carrying lines to slip in the passageway after they have been adjusted to a selected length for suspending the lamp and casing assembly proximate the second end of the tube.

8. The safety light of claim 7 wherein the high output lamp is weighted.

* * * * *